US007438331B2

(12) United States Patent
Wakatsuki

(10) Patent No.: US 7,438,331 B2
(45) Date of Patent: Oct. 21, 2008

(54) APPARATUS FOR OPENING AND CLOSING DOOR

(75) Inventor: Shoji Wakatsuki, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 10/949,206

(22) Filed: Sep. 27, 2004

(65) Prior Publication Data

US 2005/0099022 A1 May 12, 2005

(30) Foreign Application Priority Data

Nov. 11, 2003 (JP) ..... 2003-381376

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/201, 292/216, DIG. 23
See application file for complete search history.

(56) References Cited

U.S. PATENT DOCUMENTS 3,781,045 A * 12/1973 Watermann ..... 292/216
3,840,258 A * 10/1974 Brackmann ..... 292/216
5,494,322 A * 2/1996 Menke ..... 292/216
5,718,465 A * 2/1998 Dowling et al. ..... 292/216
5,893,593 A * 4/1999 Dowling ..... 292/336.3
6,032,987 A * 3/2000 Fukumoto et al. ..... 292/216
6,332,634 B1 * 12/2001 Fukumoto et al. ..... 292/201
6,406,073 B1 * 6/2002 Watanabe ..... 292/216
6,561,557 B2 * 5/2003 Choi ..... 292/336.3
6,616,202 B2 * 9/2003 Choi ..... 292/336.3
6,722,714 B2 * 4/2004 Ooe et al. ..... 292/216
7,341,291 B2 * 3/2008 Ooe et al. ..... 292/336.3
2006/0125244 A1 * 6/2006 Mochizuki et al. ..... 292/201

FOREIGN PATENT DOCUMENTS

JP 58-4077 A 1/1983
JP 62-8305 Y2 2/1987
JP H5-10113 3/1993
JP H7-6395 2/1995
JP 8-270271 A 10/1996
JP 2001-182402 A 7/2001
JP 3364113 B2 10/2002

* cited by examiner

*Primary Examiner*—Carlos Lugo
(74) *Attorney, Agent, or Firm*—Sughrue Mion, PLLC

(57) ABSTRACT

An apparatus for opening and closing a door of a vehicle, which allows a door of a vehicle to be slidably moved, includes a door operation lever that is rotated when an inside knob is operated; a door holding unit that is released by rotation of the door operation lever; an operation output unit that is included in the inside knob; and a base plate on which the inside knob is arranged in such a manner that the inside knob is moved to be operated, and on which the door operation lever is arranged in such a manner that the door operation lever partially faces an area in which the operation output unit is moved in response to an operation of the inside knob. The door operation lever is rotated by making the operation output unit abut on the door operation lever when the inside knob is operated.

2 Claims, 16 Drawing Sheets

APPARATUS FOR OPENING AND CLOSING DOOR

BACKGROUND OF THE INVENTION

1) Field of the Invention

The present invention relates to an apparatus for opening and closing a door that allows a door of a vehicle to be slidably moved by releasing a door holding unit by a rotating a door operation lever.

2) Description of the Related Art

Typical apparatus for opening and closing a door includes a fully closing holding unit that holds a slide door to be fully closed, an inside knob that is operated by a driver or a passenger, and a door operation lever that transmits a rotation of the inside knob to the fully closing holding unit as the door opening operation. In the apparatus, the fully closing holding unit, the inside knob, and the door operation lever are connected to one another by link rods or wire cables. The door operation lever rotates when the inside knob is operated to open the slide door, and the fully closing holing unit is released in response to the rotation of the door operation lever. The slide door can be thereby slidably moved to be opened.

Such apparatus that includes the fully closing holing unit, the inside knob, and the door operation lever independently requires not only an operation to install each of components individually but also an operation to connect these components by the link rods or the wire cables. As a result, an assembly of the apparatus becomes considerably complicated. To solve this problem, a technology that provides an apparatus for opening and closing a door that includes the inside knob and the door operation lever that are integrated is disclosed in, for example, Japanese Patent Application Laid-Open No. 2001-182402.

Since the inside knob and the door operation lever can be installed to the slide door as the integral unit in such apparatus, the installation of the apparatus can be facilitated. However, the apparatus still requires the operation to connect the inside knob to the door operation lever in the integral unit.

SUMMARY OF THE INVENTION

It is an object of the present invention to solve at least the above problems in the conventional technology.

An apparatus for opening and closing a door of a vehicle, which allows a door of a vehicle to be slidably moved, according to one aspect of the present invention includes a door operation lever that is rotated when an inside knob is operated; a door holding unit that is released by rotation of the door operation lever; an operation output unit that is included in the inside knob; and a base plate on which the inside knob is arranged in such a manner that the inside knob is moved to be operated, and on which the door operation lever is arranged in such a manner that the door operation lever partially faces an area in which the operation output unit is moved in response to an operation of the inside knob. The door operation lever is rotated by making the operation output unit abut on the door operation lever when the inside knob is operated.

The other objects, features, and advantages of the present invention are specifically set forth in or will become apparent from the following detailed description of the invention when read in conjunction with the accompanying drawings.

DETAILED DESCRIPTION

Exemplary embodiments of an apparatus for opening and closing a door according to the present invention are explained below in detail with reference to the accompanying drawings.

Figure 1:
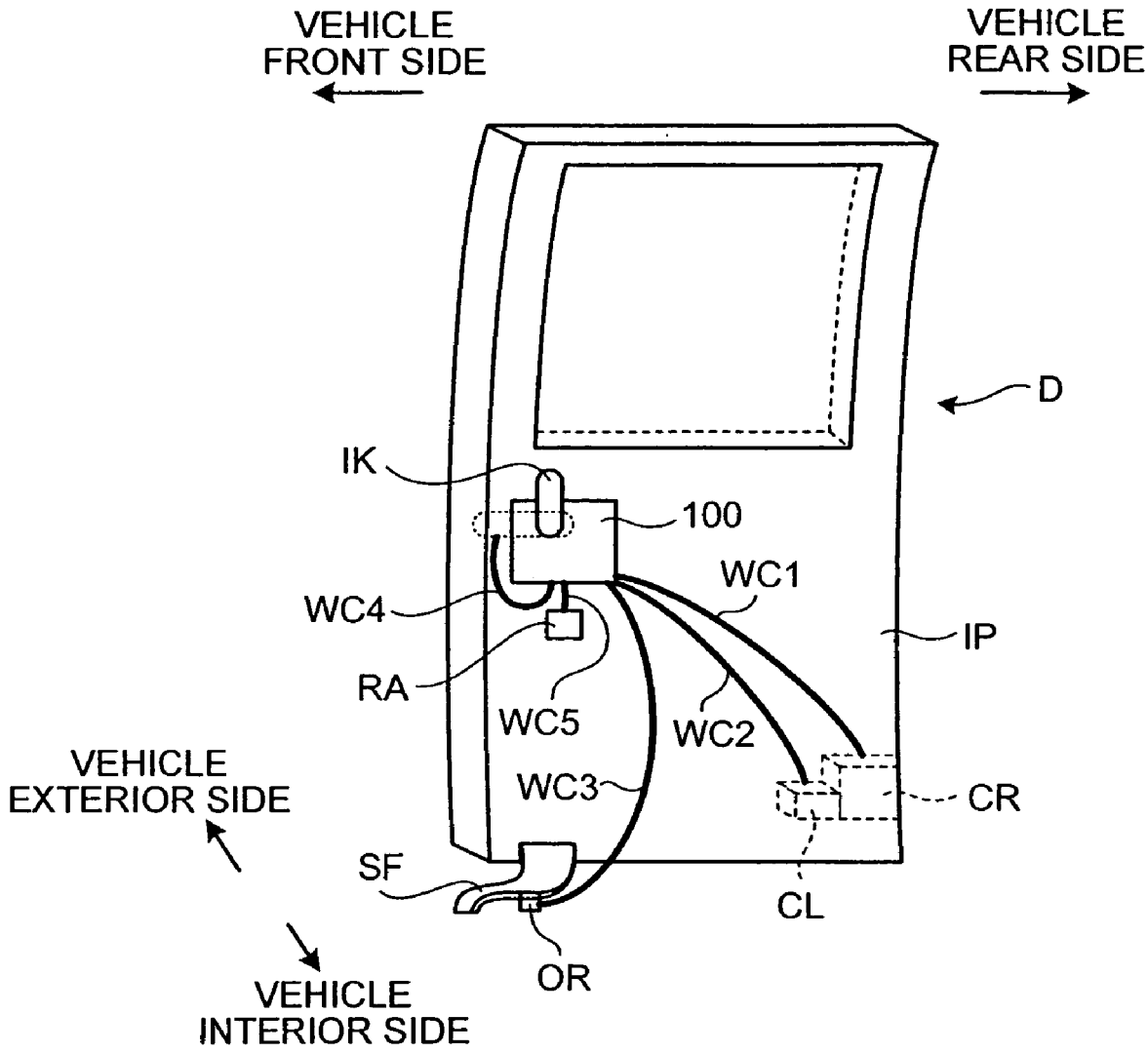
FIG. 1 is a perspective view of a slide door to which an apparatus for opening and closing a door according to an embodiment of the present invention is applied.
Figure 2:
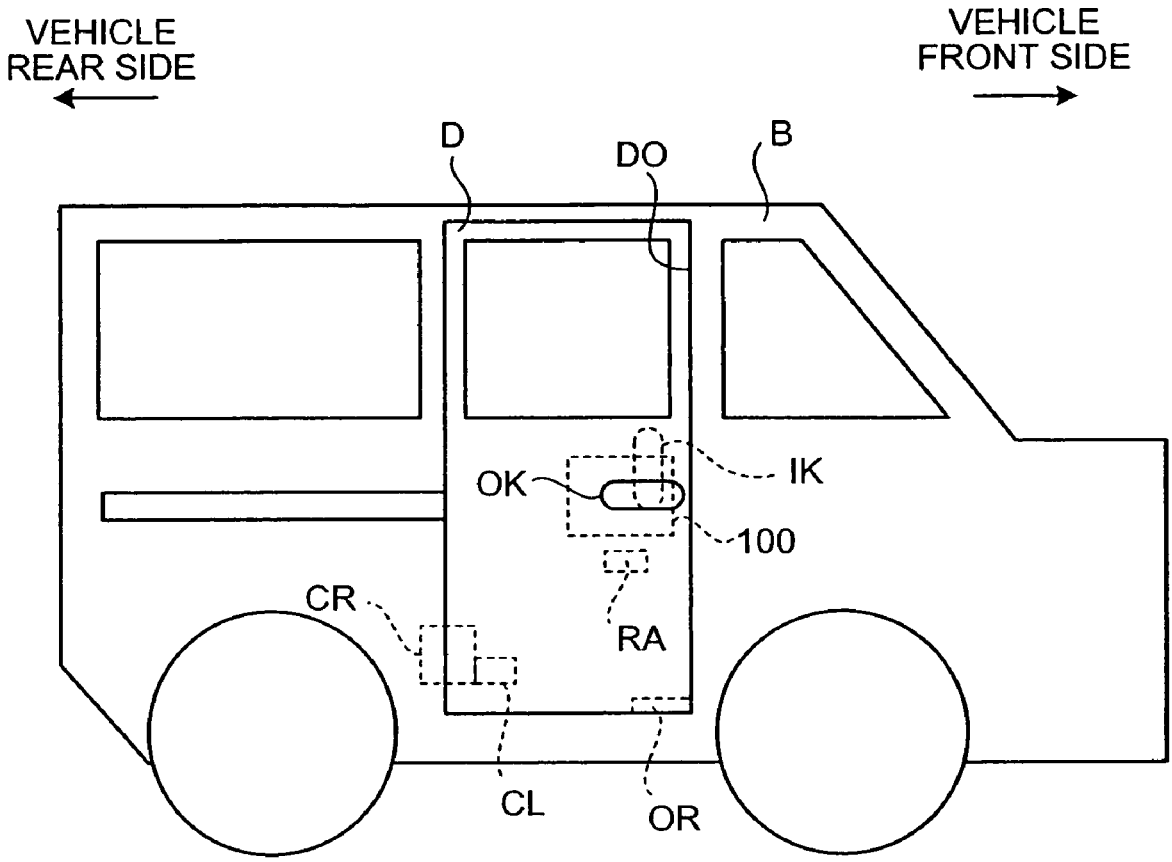
FIG. 2 is a side view of a four-wheel vehicle that includes the slide door shown in FIG. 1.
Figure 3:
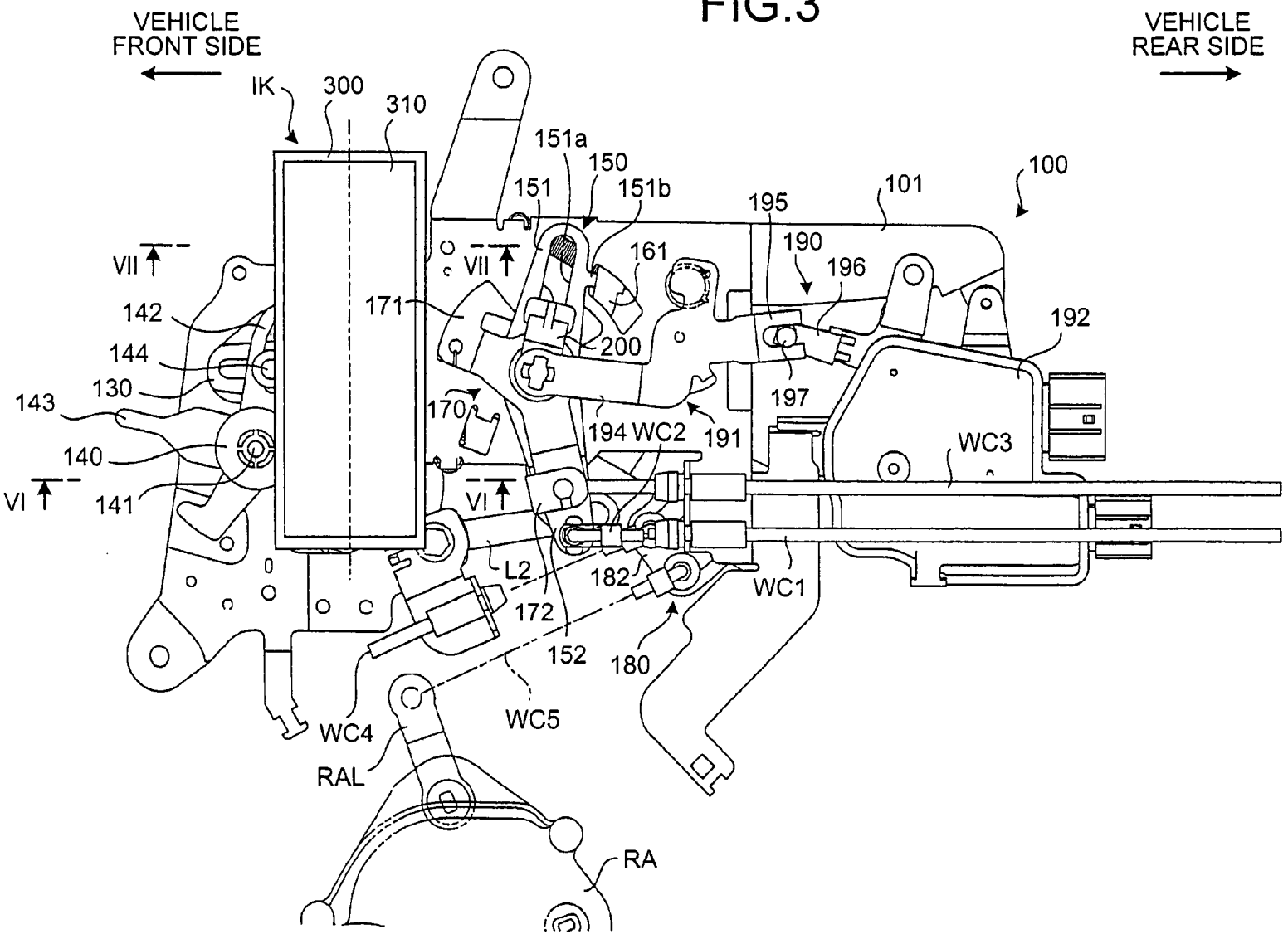
FIG. 3 is a side view of a control unit in the apparatus shown in FIG. 1 viewed from an interior side of the four-wheel vehicle.

FIG. 1 is a conceptual view of an apparatus for opening and closing a door according to an embodiment of the present invention. As shown in FIG. 2, the apparatus shown is arranged between a vehicle body B of a four-wheel vehicle and a slide door D. The apparatus includes a fully closing latch unit CR that serves as a fully closing holding unit, a fully opening latch unit OR that serves as a fully opening holding unit, and a control unit 100.

The slide door D, to which the apparatus is applied, opens or closes a door opening DO, through which a passenger enters to a vehicle, by sliding along a side body of the vehicle. An example of the apparatus that opens or closes the slide door D situated on a right side of the vehicle body B, which is a door provided on the side body in a rearward side of a driver's sheet in a right-hand drive vehicle, will be explained herein.

The fully closing latch unit CR holds the slide door D to be fully closed, and is arranged between a rear edge of the slide door D and the vehicle body B. The fully closing latch unit CR includes a closer device CL. The closer device CL is an actuator that includes a clutch mechanism (not shown). When the fully closing latch unit CR is in a half latched state, the closer device CL functions to turn the fully closing latch unit CR into a fully latched state on condition that the cutch mechanism is connected. Even while turning to the fully latched state, the closer device CL discontinues turning once the clutch mechanism is disconnected.

The fully opening latch unit OR is arranged between the vehicle body B and a support frame SF that is arranged in the slide door D, and holds the slide door D in a fully opened state. The support frame SF is arranged at a lower end of an inner panel IP on the vehicle front side protruding toward a vehicle interior side.

The fully closing latch unit CR and the fully opening latch unit OR are same in a configuration as a conventional latch unit. For example, each of the fully closing latch unit CR and the fully opening latch unit OR includes a latch to be engaged with a striker in the vehicle body B, and a ratchet that controls the latch.

The control unit 100 releases engagement of the fully closing latch unit CR and the fully opening latch unit OR, when an outside knob OK or an inside knob IK in the slide door D is operated, by an operation caused following the operation of the outside knob OK or the inside knob IK.

An example of configuration of the control unit 100 according to the present embodiment is shown in FIGS. 3 to 9. The control unit 100 is arranged at an upper portion on a surface of the inner panel IP on a vehicle interior side through a base plate 101. An inside knob lever shaft 102 is arranged on the base plate 101. The inside knob lever shaft 102 includes a door opening lever 110, a door closing lever 120, and a link lever 130. A child lock lever 140 is arranged on the base plate 101 in such a manner that the child lock lever 140 is situated around the inside knob lever shaft 102.

The door opening lever 110 is arranged at a proximal end of the inside knob lever shaft 102 in such a manner the door opening lever 110 is arranged at a proximal end of t the inside knob lever shaft 102 in such a manner that the door opening lever 110 rotates integrally with the inside knob lever shaft 102 on a rear surface, which faces the vehicle exterior side, of the base plate 101. The door opening lever 110 includes a link engagement unit 111 and a first handle engagement unit 112. The link engagement unit 111 is arranged at a portion of the door opening lever 110 that extends from the inside knob lever shaft 102 toward a vehicle front side. The first handle engagement unit 112 is arranged at a portion of the door opening lever 110 that extends substantially downward from the inside knob lever shaft 102. The first handle engagement unit 112 is formed sufficiently larger in length than the link engagement unit 111, and includes a first handle engagement piece 113 and a first door operation detection unit 114. The first handle engagement piece 113 is a portion that is bent to extend from an edge on the vehicle rear side in a lower portion of the first handle engagement unit 112 toward a vehicle interior side. The first handle engagement piece 113 includes a first abutment surface 113*a* at a portion that faces toward the vehicle rear side. The first abutment surface 113*a* protrudes on a front surface of the base plate 101 through a notch formed in the base plate 101. The first door operation detection unit 114 is arranged at a portion of the first handle engagement unit 112 that slightly extends downward from a lowermost end of the first handle engagement unit 112 toward the vehicle rear side. When the first handle engagement unit 112 is directed downward, the first door operation detection unit 114 is not in contact with a first door operation detection sensor S1 that is arranged on the base plate 101. Only when the door opening lever 110 rotates clockwise in FIG. 4, the first door operation detection unit 114 comes in contact with the first door operation detection sensor S1 to turn on the first door operation detection sensor S1. A return spring 116 (not shown) is arranged between a spring engagement unit 115 in the door opening lever 110 and the base plate 101. The return spring 116 is to hold the first handle engagement unit 112 in such a manner that the first handle engagement unit 112 is directed downward in a substantially vertical direction.

The door closing lever 120 is arranged between the door opening lever 110 and the base plate 101 in such a manner that to the door closing lever 120 rotates integrally with the inside knob lever shaft 102 on the rear surface of the base plate 101. The door closing lever 120 includes a second handle engagement unit 121 and a second door operation detection unit 122. The second handle engagement unit 121 is arranged at a portion of the door closing lever 120 that extends upward from the inside knob lever shaft 102. The second handle engagement unit 121 includes a second handle engagement piece 123 and a first link slide connecting unit 124. The second handle engagement piece 123 is a portion that is bent to extend from a side edge located on the vehicle front side on an upper end of the door closing lever 120 toward the vehicle interior side. The second handle engagement piece 123 includes a second abutment surface 123*a* at a portion that faces toward the vehicle front side. The second handle engagement piece 123 is located above the base plate 101, and the second abutment surface 123*a* thereof protrudes out of the front surface of the base plate 101. Furthermore, the second handle engagement piece 123 is arranged substantially equidistantly to the first handle engagement piece 113 around the inside knob lever shaft 102. The second abutment surface 123*a* is arranged on a plane that includes the inside knob lever shaft 102 and the first abutment surface 113*a*. The first link slide connecting unit 124 is connected to one end of a first connection link L1 through an elongate hole formed between the inside knob lever shaft 102 and the second handle engagement piece 123. The door closing lever 120 includes a bend so as to make the door closing lever 120 extend downward from the inside knob lever shaft 102 and then toward the vehicle front side. The second door operation detection unit 122 is arranged at a portion that extends toward the vehicle front side. When the second handle engagement unit 121 is directed upward, the second door operation detection unit 122 is not in contact with a second door operation detection sensor S2 that is arranged on the base plate. Only when the door closing lever 120 rotates clockwise in FIG. 4, the second door operation detection unit 122 comes in contact with the second door operation detection sensor S2 to turn the second door operation detection sensor S2 on.

The link lever 130 is arranged between the base plate 101 and the door closing lever 120 in such a manner that the link lever 130 is rotatable around the inside knob lever shaft 102. The link lever 130 includes a pin slide unit 131 and a second link slide connecting unit 132. The pin slide unit 131 is arranged at a portion of the link lever 130 that extends from the inside knob lever shaft 102 along the link engagement unit 111. The pin slide unit 131 includes a pin slide groove 131*a* that extends in a radial direction of an axis of the inside knob lever shaft 102. The link lever 130 includes a bend so as to make the link lever 130 extend downward from the inside knob lever shaft 102, and then toward the vehicle front side. The second link slide connecting unit 132 is arranged at a portion that extends toward the vehicle front side. One end of a second connection link L2 is connected to the second link slide connecting unit 132 through an elongate hole.

The child lock lever 140 is rotatably arranged, through a child lock lever shaft 141, on the rear surface of the base plate 101 at a portion on a vehicle front side of the inside knob lever shaft 102. The child lock lever 140 includes a pin operation unit 142 and a switch operation unit 143. The pin operation unit 142 is arranged at a portion of the child lock lever 140 that extends from the child lock lever shaft 141 in such a manner that the portion crosses the pin slide unit 131 of the link lever 130. The pin operation unit 142 includes a pin operation groove 142*a*. The pin operation groove 142*a* extends along a longitudinal direction of the pin operation unit 142, and includes therein an engagement pin 144. The engagement pin 144 is slidably provided along a longitudinal direction of the pin operation groove 142*a*. An end of the engagement pin 144 that is situated on the vehicle exterior side protrudes out of the rear surface of the base plate 101 through a notch formed in the base plate 101 to be engaged with the pin slide groove 131*a* in the child lock lever 140. The switch operation unit 143 is to switch the child lock lever 140, and extends from the child lock lever shaft 141 toward the vehicle front side. When the child lock lever is in an unlock position, the child lock lever 140 functions to locate the engagement pin 144 in a rotational movement area of the link engagement unit 111 in the pin slide unit 131. When the child lock lever 140 is in a lock position, the child lock lever 140 functions to locate the engagement pin 144 outside of the rotational movement area.

The control unit 100 includes an open lever 150, an open sub-lever 160, a lower open lever 170, an open handle lever 180, and a lock unit 190 on the base plate 101 at a portion on the vehicle rear side relative to the inside knob lever shaft 102. The open lever 150, the lower open lever 170, and the open handle lever 180 are arranged on the base plate 101 through a lever shaft 104 that is common for the open lever 150, the lower open lever 170, and the open handle lever 180, and are individually rotatable around a center axis of the lever shaft 104.

The open lever 150 is arranged on the front surface of the base plate 101, and includes a sub-lever engagement unit 151 and a wire cable connecting unit 152. The sub-lever engagement unit 151 is arranged at a portion of the open lever 150 that extends upward from the lever shaft 104, and includes a lock pin slide groove 151 and an engagement convex portion 151*b*. The lock pin slide groove 151 is formed in a substantially straight line along a direction in which the sub-lever engagement unit 151 extends. The engagement convex portion 151*b* is a portion that is bent from an edge along the vehicle rear side of the sub-lever engagement unit 151 toward the base plate 101. The engagement convex portion 151*b* protrudes on the rear surface of the base plate 101 through a notch formed in the base plate 101. The wire cable connecting unit 152 is arranged at a portion that extends from the lever shaft 104 slightly downward toward the vehicle rear side. One end of a first wire cable WC1 and one end of a second wire cable WC2 are connected to the wire cable connecting unit 152. Another end of the first wire cable WC1 is connected to the fully closing latch unit CR. Thus the first wire cable WC1 enables a cancel operation for the fully closing latch unit CR when the first wire cable WC1 is pulled. Another end of the second wire cable WC2 is connected to the closer device CL of the fully closing latch unit CR. Thus, the second wire cable WC2 enables to switch the clutch mechanism of the closer device CL from a connected state to a disconnected state when the second wire cable WC2 is pulled.

The open sub-lever 160, which is provided on the rear surface of the base plate 101, includes an open lever engagement unit 161, a first link connecting unit 162, a handle lever engagement unit 163, and a lock pin engagement unit 164. The open lever engagement unit 161 is arranged at a portion of the open sub-lever 160 that extends upward from the lever shaft 104. The open lever engagement unit 161 is abutted on and engaged with the engagement convex portion 151*b* in the open lever 150 on a surface of the open lever engagement unit 161 that faces the vehicle front side. One end of a first coil spring 166 is connected to the open lever engagement unit 161 through a coil spring connecting unit 165. The first coil spring 166 interposes between the open lever engagement unit 161 and the base plate 101, and always pushes the open sub-lever 160 in a clockwise direction in FIG. 5. The first link connecting unit 162 extends downward from the lever shaft 104, and that is then bent to extend toward the vehicle rear side. Another end of the second connection link L2 is connected to the first link connecting unit 162. The handle lever engagement unit 163 slightly protrudes from the lever shaft 104 toward the vehicle front side, and that is then bent to extend toward the vehicle exterior side. The lock pin engagement unit 164 extends along the sub-lever engagement unit 151 while securing an engagement concave portion 164*a* that fits to the lock pin slid groove 151*a* between the lock pin engagement unit 164 and the open lever engagement unit 161 when the open lever engagement unit 161 is abutted on and engaged with the sub-lever engagement unit 151 of the open lever 150 through the engagement convex portion 151*b*. The lock pin engagement unit 164 is sufficiently shorter than the lock pin slide groove 151*a* of the open lever 150, and has a length substantially equal to a width of the lock pin slide groove 151*a*.

The lower open lever 170 is arranged on the front surface of the base plate 101 on the vehicle interior side relative to the open lever 150. The lower open lever 170 includes a second link connecting unit 171 and a third wire cable connecting unit 172. The second link connecting unit 171 extends from the lever shaft 104 slightly upward toward the vehicle front side, and is bent toward the base plate 101, thereby extending toward the rear surface of the base plate 101 through a notch formed in the base plate 101. A portion of the second link connecting unit 171 that extends toward the rear surface of the base plate 101, extends upward and then extends slightly downward toward the vehicle rear side. Another end of the first connection link L1 is connected to the second link connecting unit 171, and a second coil spring 173 is connected to the second link connecting unit 171 on a proximal side relative to the first connection link L1. The second coil spring 173 interposes between the second link connecting unit 171 and the base plate 101, and always pushes the lower open lever 170 in a clockwise direction in FIG. 5. The third wire cable connecting unit 172 extends from the lever shaft 104 along the wire cable connecting unit 152 of the open lever 150. One end of a third wire cable WC3 is connected to the third wire cable connecting unit 172. Another end of the third wire cable WC3 is connected to the fully opening latch unit OR. Thus, a cancel operation for fully opening latch unit OR can be performed when the wire WC3 is pulled.

The open handle lever 180 is arranged on the rear surface of the base plate 101 on the vehicle exterior side relative to the open sub-lever 160. The open handle lever 180 includes a double lever engagement unit 181, a wire cable slide connecting unit 182, and a third door operation detection unit 183. The double lever engagement unit 181 extends from a region of the lever shaft 104 located on a lower peripheral surface of the lever shaft 104 toward the vehicle front side. The double lever engagement unit 181 is abutted on a lower end surface of the handle lever engagement unit 163 of the open sub-lever 160 and a lower surface of the second link connecting unit 171 of the lower open lever 170 through on a surface that is directed upward. The wire cable slide connecting unit 182 extends downward from the lever shaft 104 toward the vehicle rear side. One end of a fourth wire cable WC4 and one end of a fifth wire cable WC5 are slidably connected to the wire cable slide connecting unit 182 through elongate holes. Another end of the fourth wire cable WC4 is connected to the outside knob OK. The fourth wire cable WC4 functions to rotate the open handle lever 180 clockwise when the outside knob OK is operated. The other end of the fifth wire cable WC5 is connected to a release actuator RA. The release actuator RA is installed in the slide door D at a portion below the control unit 100, and includes a release output lever RAL in its upper portion. The release output lever RAL is rocked around an output shaft, which is parallel to the lever shaft 104, and another end of the fifth wire cable WC5 is connected to a tip end of the release output lever RAL. In a normal state of the release actuator RA, the release output lever RAL is rocked to direct toward the vehicle rear side. In this state, no tensile force is generated across the fifth wire cable WC5 connected to the open handle lever 180. For example, when the first door operation detection sensor S1 and the second door operation detection sensor S2 are turned on from this state, the release actuator RA is driven in response to ON states of the first door operation detection sensor S1 and the second door operation detection sensor S2 as a trigger. In addition, the release actuator RA rocks the release output lever RAL toward the vehicle front side to rock the open handle lever 180 counterclockwise through the fifth wire cable WC5 in FIG. 5. The third door opening detection unit 183 protrudes from a tip end of the wire cable slide connecting unit 182. When the wire cable slide connecting unit 182 is directed to extend downward from the lever shaft 104 toward the vehicle rear side, the third door opening detection unit 183 is not in contact with a third door operation detection sensor S3 that is arranged on the base plate 101. Only when the open handle lever 180 rotates counterclockwise in FIG. 5, the third door opening detection unit 183 comes in contact with the third door operation detection sensor S3 to turn on the door operation detection sensor S3.

The lock unit 190 includes a locking lever 191 and a locking actuator 192. The locking lever 191 is rotatably arranged, through a lock lever shaft 193, on the front surface of the base plate 101 at a portion on the vehicle rear side relative to the lever shaft 104. The locking lever 191 includes a lock pin holding unit 194 and an actuator engagement unit 195. The lock pin holding unit 194 is arranged at a portion that extends from the lock lever shaft 193 toward the vehicle rear side. A lock member 200 is formed in the lock pin holding unit 194 at its extended end. The lock member 200 is rotatably supported by the lock pin holding unit 194 through its proximal end, and includes a lock pin 201 at a tip end of the lock member 200. The lock pin 201 is cylindrical and protrudes from the tip end of the lock member 200 toward the base plate 101. An end of the lock pin 201 penetrates through the lock pin slide groove 151*a* and the notch formed in the base plate 101 to be engaged with an engagement concave portion 164*a* formed between the open lever engagement unit 161 of the open sub-lever 160 and the lock pin engagement unit 164. The actuator engagement unit 195 is arranged at a portion that extends from the lock lever shaft 193 toward the vehicle rear side, and that has a tip end branched into two units. The locking actuator 192 is arranged at a portion that is situated closest to the rear of the vehicle in the base plate 101. The locking actuator 192 includes a locking output lever 196 at an upper portion on the vehicle front side. The locking output lever 196 is vertically rocked along the front surface of the base plate 101, and an engagement protrusion 197 that is formed at a tip end of the locking output lever 196 is engaged with a branch unit of the actuator engagement unit 195. The locking actuator 192 moves the lock pin holding unit 194 downward through the actuator engagement unit 195 and locates the lock pin 201 in an area in which the lock pin engagement unit 164 makes rotational movement in the lock pin slide groove 151*a* of the open lever 150, thereby unlocking the open lever 150 when the locking output lever 196 is rocked most upward. The locking actuator 192 moves the lock pin holing unit 194 upward through the actuator engagement unit 195 and locates the lock pin 201 outside of the area in which the lock pin engagement unit 164 makes the rotational movement in the lock pin slide groove 151*a*, thereby locking the open lever 150 when the locking output lever 196 is rocked most downward.

The control unit 100 includes the inside knob IK. The inside knob IK includes a knob base member 300 and an operation knob member 310. The knob base member 300 and the operation knob member 310 are connected to each other through an operation shaft member 320 along a longitudinal direction of the knob base member 300. The operation knob member 310 can be tilted around a center axis of the operation shaft member 320 relatively to the knob base member 300. A first operation output unit 311 and a second operation output unit 312 are arranged on both ends of the operation knob member 310 along a longitudinal direction of the operation shaft member 320. The first operation output unit 311 and the second operation output unit 312 are arranged at a portion of the operation knob member 310 that faces the knob base member 300. The first operation output unit 311 and the second operation output unit 312 protrude out of a rear surface of the knob base member 300 through notches formed in the knob base member 300. If the operation shaft member 320 is arranged along a vertical direction, the second operation member 312 located above is arranged in left side of a center axis of the operation shaft member 320 and includes a second pressing surface 312*a* on a right end. In addition, the first operation output unit 311 located below is provided in a right side of the center axis of the operation shaft member 320, and includes a first pressing surface 311*a* on a left end. The first operation output unit 311 and the second operation output unit 312 are arranged to keep an interval therebetween that is equal to an interval between the first handle engagement piece 113 and the second handle engagement piece 123.

The inside knob IK is arranged on the base plate 101 through the knob base member 300 in such a manner that the center axis of the operation shaft member 320 is substantially orthogonal to the center axis of that inside knob lever 102 and a midpoint between the first operation output unit 311 and the second operation output unit 312 is located on a line extended from the center axis of the inside knob lever shaft 102. In this state, the first pressing surface 311*a* of the first operation output unit 311 faces the first abutment surface 113*a* of the first handle engagement unit 112 closely. In addition, the second pressing surface 312*a* faces the second abutment surface 123*a* of the second handle engagement unit 121.

According to the apparatus described above, the inside knob IK as well as the door operation levers that include the door opening lever 110 and the door closing lever 120I is arranged on the base plate 101. Therefore, the inside knob IK, the door opening lever 110, and the door closing lever 120 can be installed as an integral member in the slide door D. Furthermore, the first operation output unit 311 and the second operation output unit 312 are formed in the inside knob IK, and the door opening lever 110 and the door closing lever 120 are arranged on the base plate 101 in such a manner that a part of the door opening lever 110 and a part of the door closing lever 120 face an area in which the first operation output unit 311 and the second operation output unit 312 move. Therefore, operation for connecting the inside knob IK to the door opening lever 110 and the door closing lever 120 is not necessary, thereby making it possible to extremely facilitate an assembly operation.

FIGS. 10 to 17 are conceptual views of the control unit 100 when the control unit 100 operates.

The control unit 100 is first mounted on the inner panel IP in such a manner that the operation knob member 310 of the inside knob IK is exposed to the vehicle interior side to be operated by a passenger. If the control unit 100 is in an initial state, the operation knob member 310 is in a neutral state. In addition, the first pressing surface 311*a* of the first operation output unit 311 is not in contact with the first abutment surface 113*a* of the first handle engagement unit 112. The second pressing surface 312*a* of the second operation output unit 312 is not in contact with the second abutment surface 123*a* of the second handle engagement unit 121. In the initial state shown in FIGS. 5 to 7, the child lock lever 140 is at an unlock position, and the lock unit 190 is unlocked.

Figure 6:
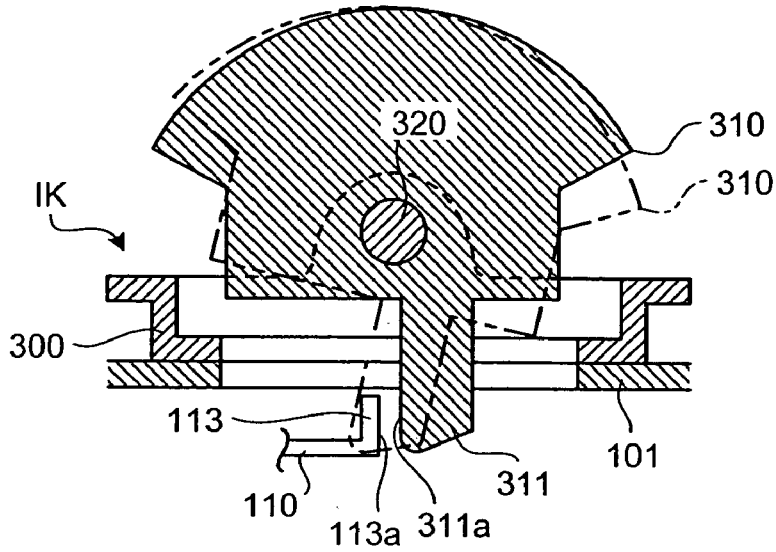
FIG. 6 is a cross-section of the control unit taken along a line VI-VI in FIG. 3.
Figure 10:
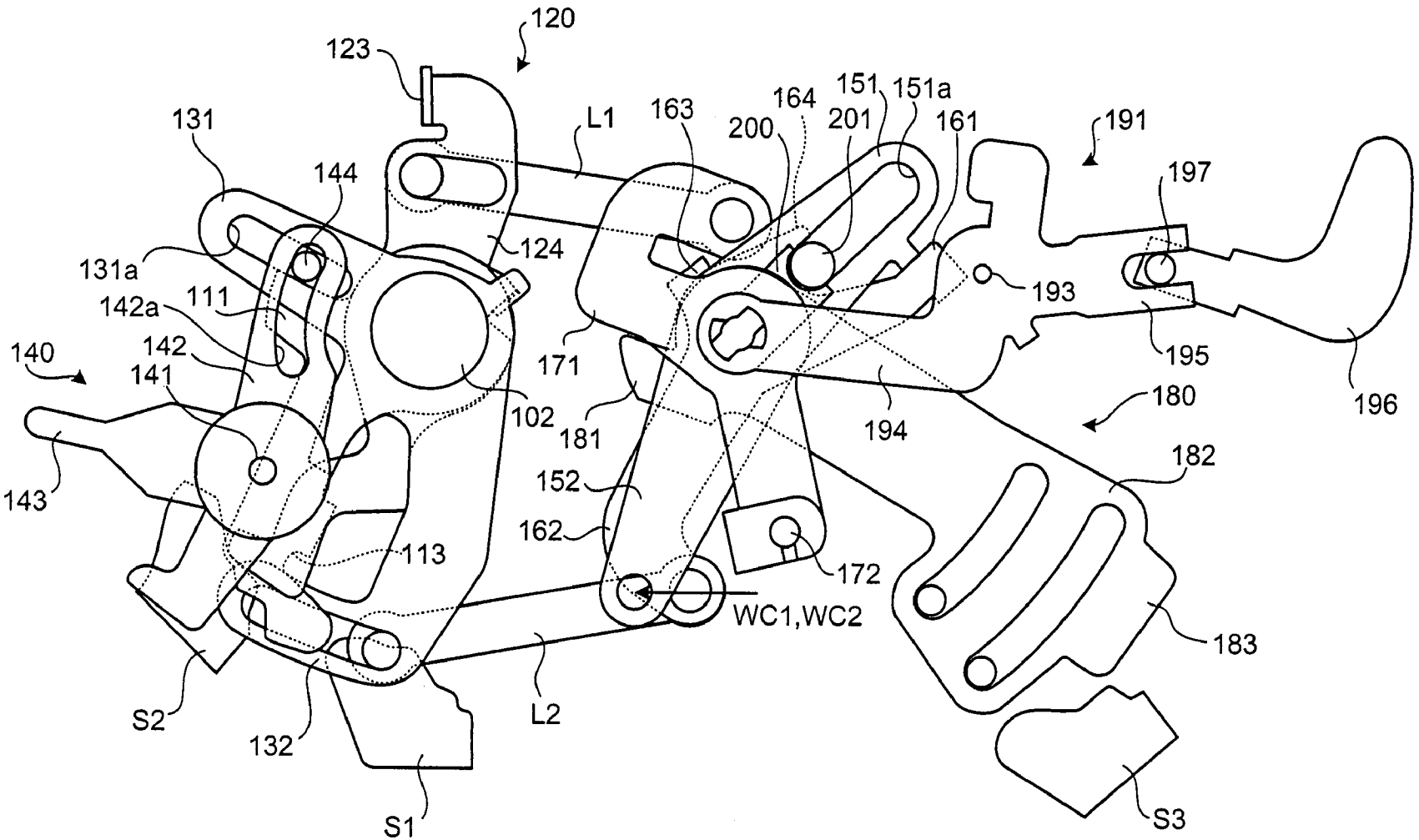
FIG. 10 is a conceptual view of the control unit shown in FIG. 3 when an inside knob is operated to open a door.

When the inside knob IK is tilted toward the vehicle rear side from this initial state to open a door, the first operation output unit 311 is abutted on the first abutment surface 113*a* of the first handle engagement unit 112 through the first pressing surface 311*a* as indicated by a two-dot chain line shown in FIG. 6. As a result, the door opening lever 110 rotates clockwise in FIG. 4. When the door opening lever 110 rotates clockwise, the rotation of the door opening lever 110 is transmitted to the link lever 130 through the link engagement unit 111 and the engagement pin 144, and the link lever 130 rotates clockwise as shown in FIG. 10.

When the ink lever 130 rotates, the open sub-lever 160 is rotated clockwise through the second connection link L2. Furthermore, the rotation of the open sub-lever 160 is transmitted to the open lever 150 through the lock pin engagement unit 164 and the lock pin 201, whereby the first wire cable WC1 and the second wire cable WC2 are pulled. When the first wire cable WC1 is pulled, the fully closing latch unit CR is released. As a result, for example, even if the slide door D is fully closed, the slide door D can be opened and moved by tilting the inside knob IK toward the vehicle rear side. Furthermore, when the second wire cable WC2 is pulled, the clutch mechanism of the closer device CL is disconnected. Therefore, for example, even while the closer device CL is in operation, the operation to turn from the half latched state to the fully latched state can be disconnected by tilting the inside knob IK toward the vehicle rear side. When the door opening lever 110 rotates clockwise, the first door operation detection unit 114 turns on the first door operation detection sensor S1. Therefore it is possible to detect that the inside knob IK is tilted toward the vehicle rear side based on a detection result of the first door operation detection sensor S1.

Figure 4:
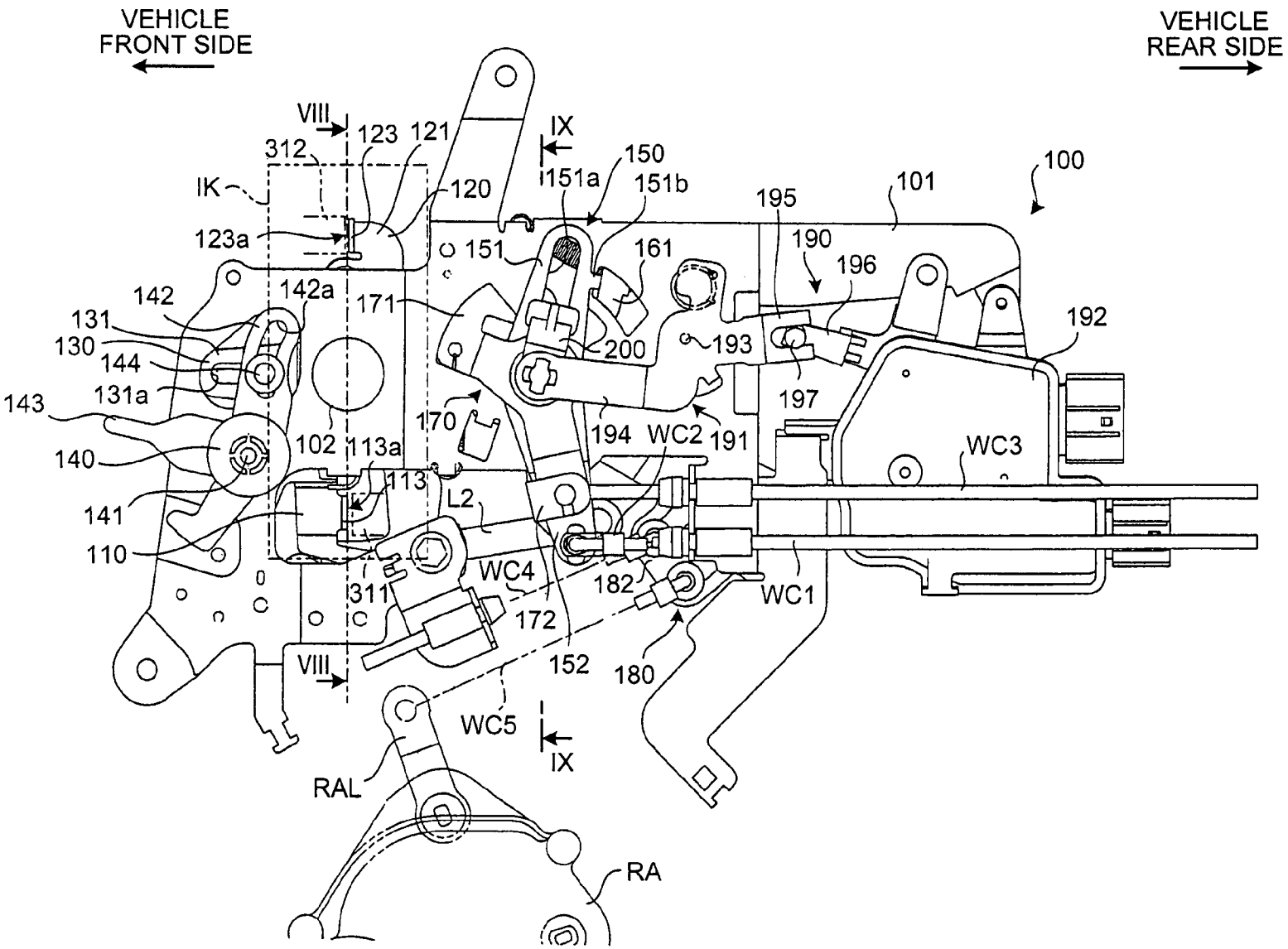
FIG. 4 is a detailed side view of the control unit in FIG. 3 viewed from the interior side.
Figure 5:
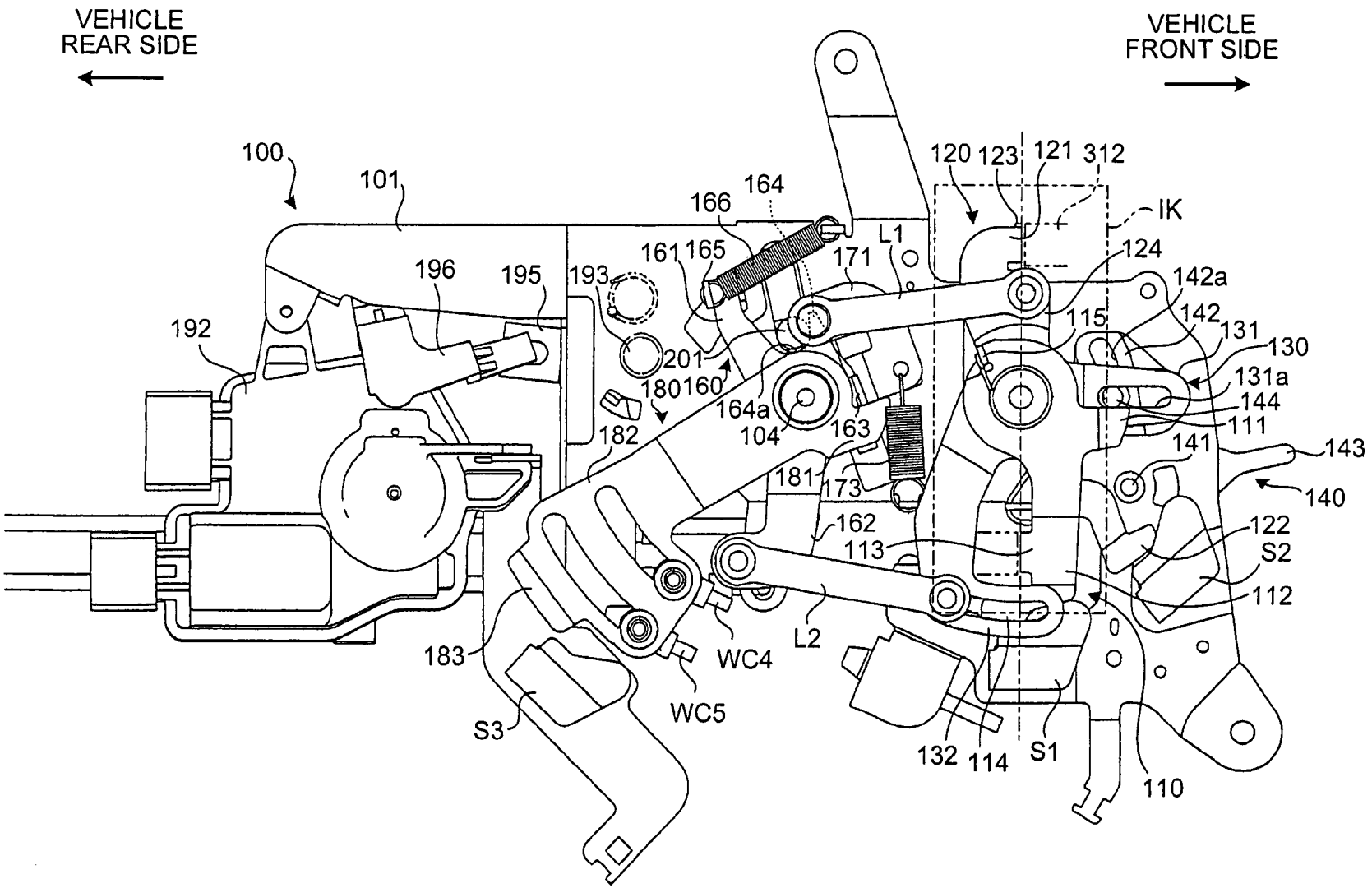
FIG. 5 is a detailed side view of the control unit in FIG. 3 viewed from an exterior side of the four-wheel vehicle.
Figure 7:
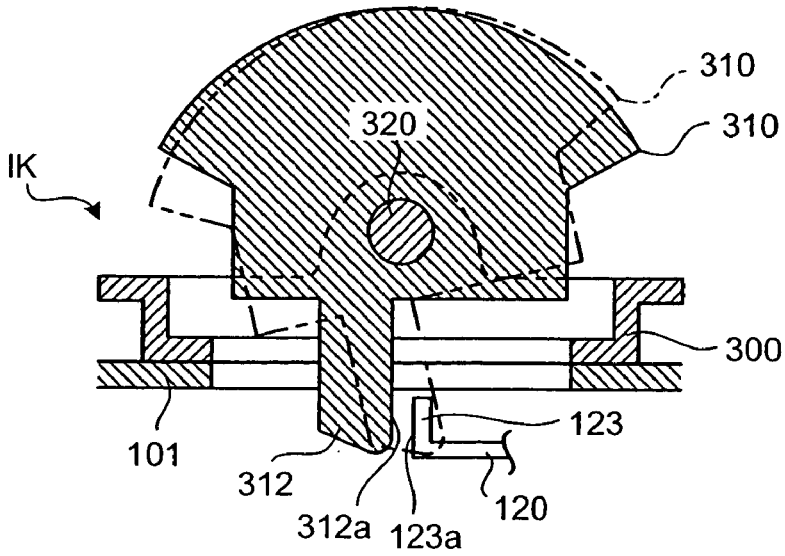
FIG. 7 is a cross-section of the control unit taken along a line VII-VII in FIG. 3.
Figure 8:
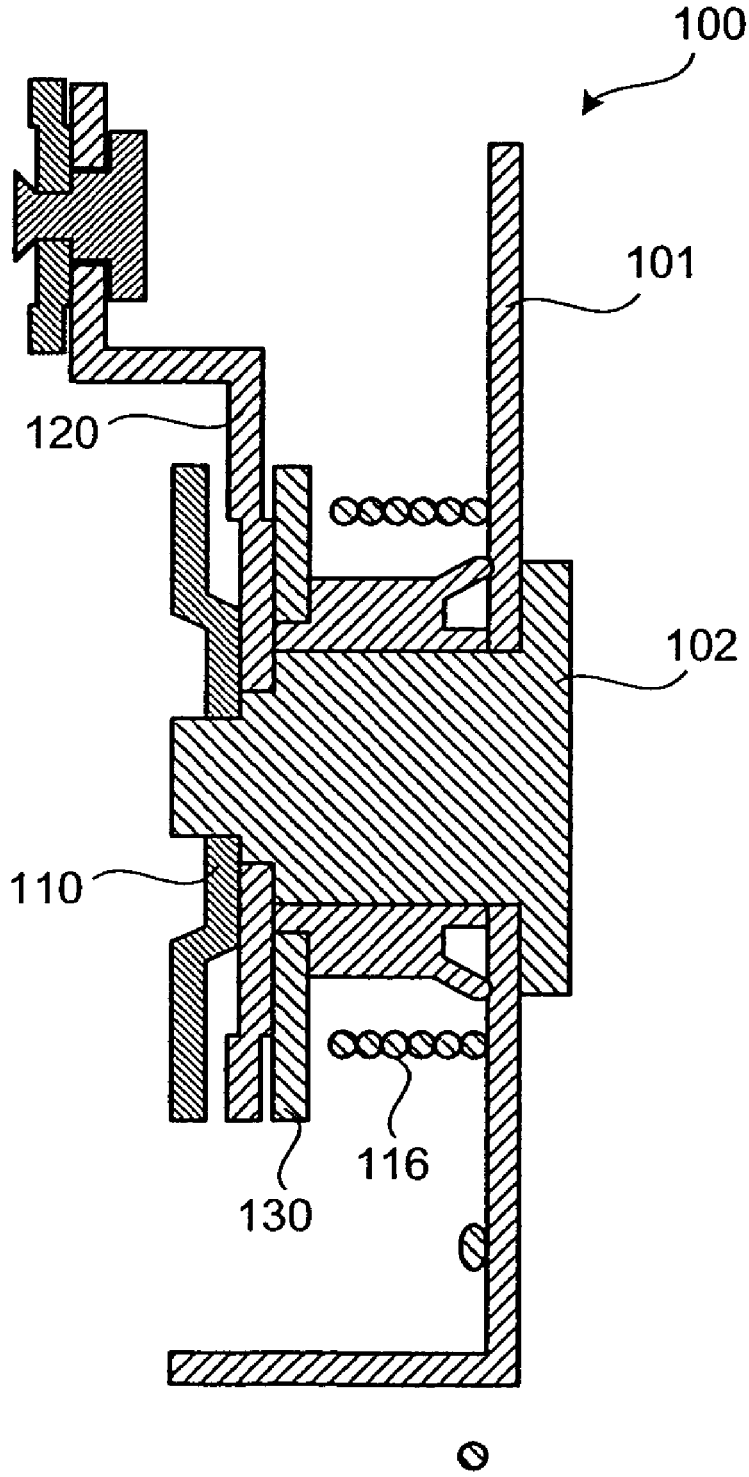
FIG. 8 is a cross-section of the control unit taken along a line VIII-VIII in FIG. 4.
Figure 9:
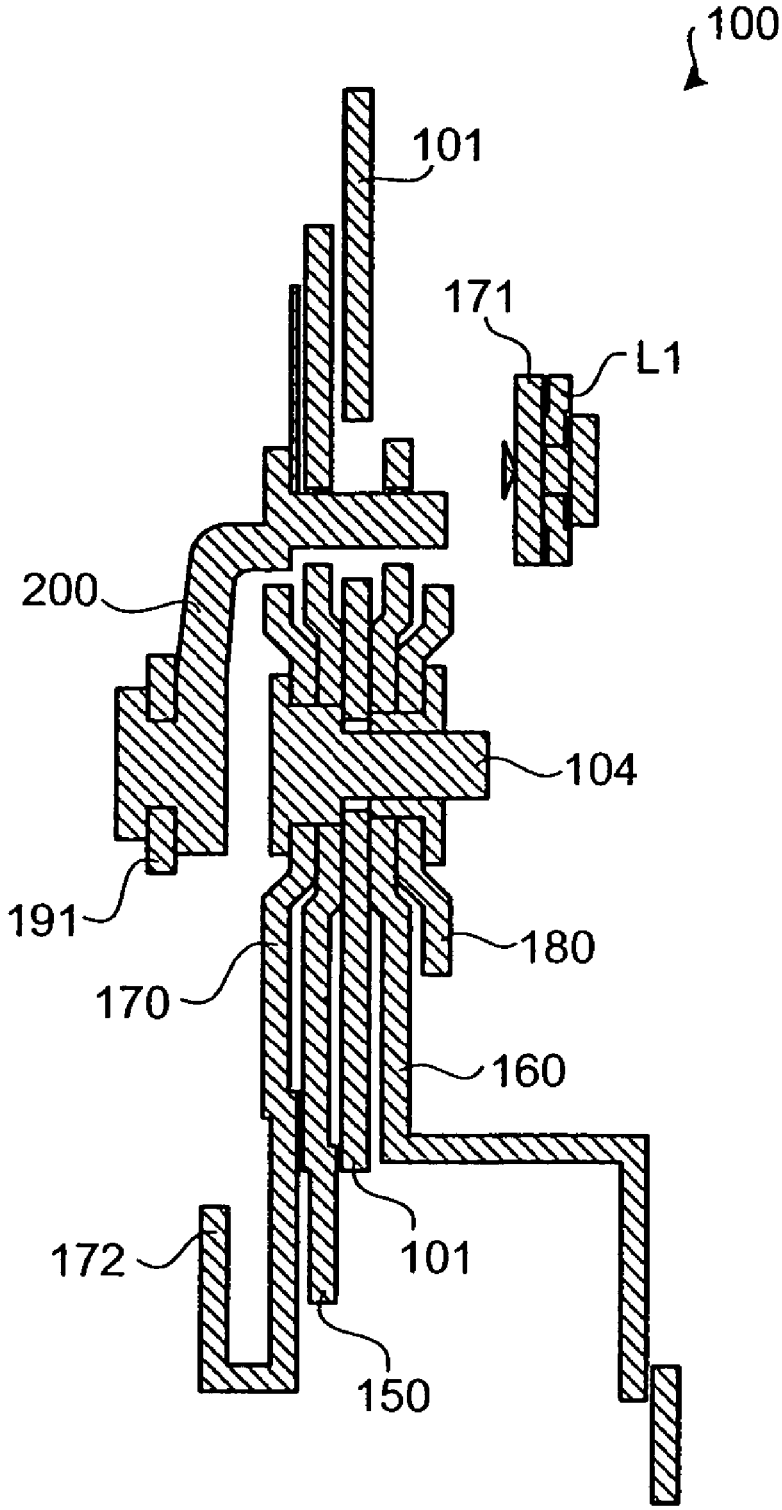
FIG. 9 is a cross-section of the control unit taken along a line IX-IX in FIG. 4.
Figure 11:
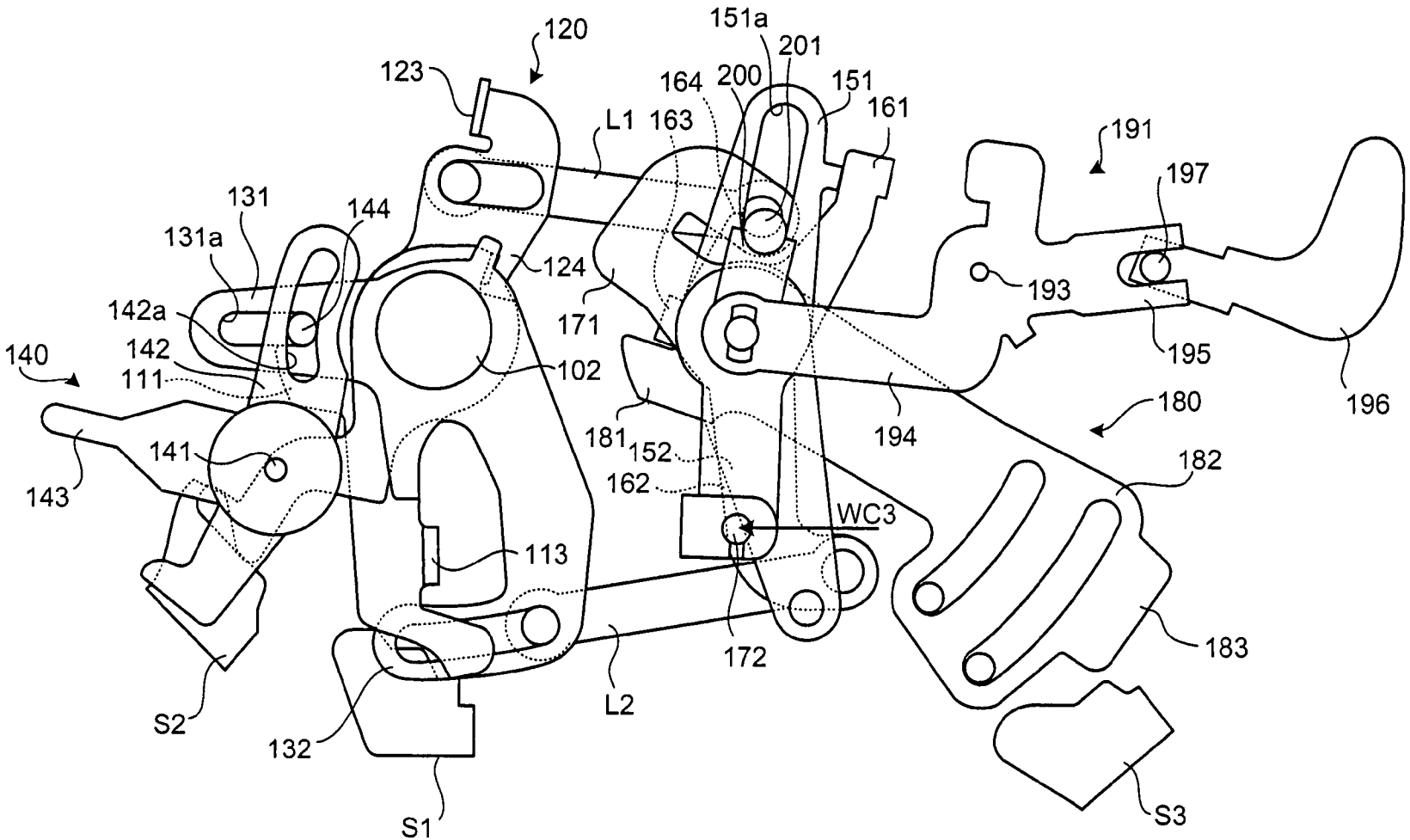
FIG. 11 is a conceptual view of the control unit shown in FIG. 3 when the inside knob is operated to close the door.

When the inside knob IK is tilted toward the vehicle front side to close a door, the second operation output unit 312 is abutted on the second pressing surface 312*a* of the second handle engagement unit 121 through the second pressing surface 312*a* as indicated by a two-dot chain line shown in FIG. 7, and the door closing lever 120 rotates clockwise in FIG. 4. When the door closing lever 120 rotates clockwise, as shown in FIG. 11, the rotation of the lever is transmitted to the lower open lever 170 through the first connection link L1, whereby making the lower open lever 170 rotate clockwise. When the lower open lever 170 rotates clockwise, the third wire cable WC3 is pulled and the fully opening latch unit OR is released. Therefore, for example, even if the slide door D is fully opened, the slide door D can be closed and moved by tilting the inside knob IK toward the vehicle front side. When the door closing lever 120 rotates clockwise, the second door operation detection unit 122 turns on the second door operation detection sensor S2. Therefore, it is possible to detect that the inside knob IK is tilted toward the vehicle front side based on a detection result of the second door operation detection sensor S2.

Figure 12:
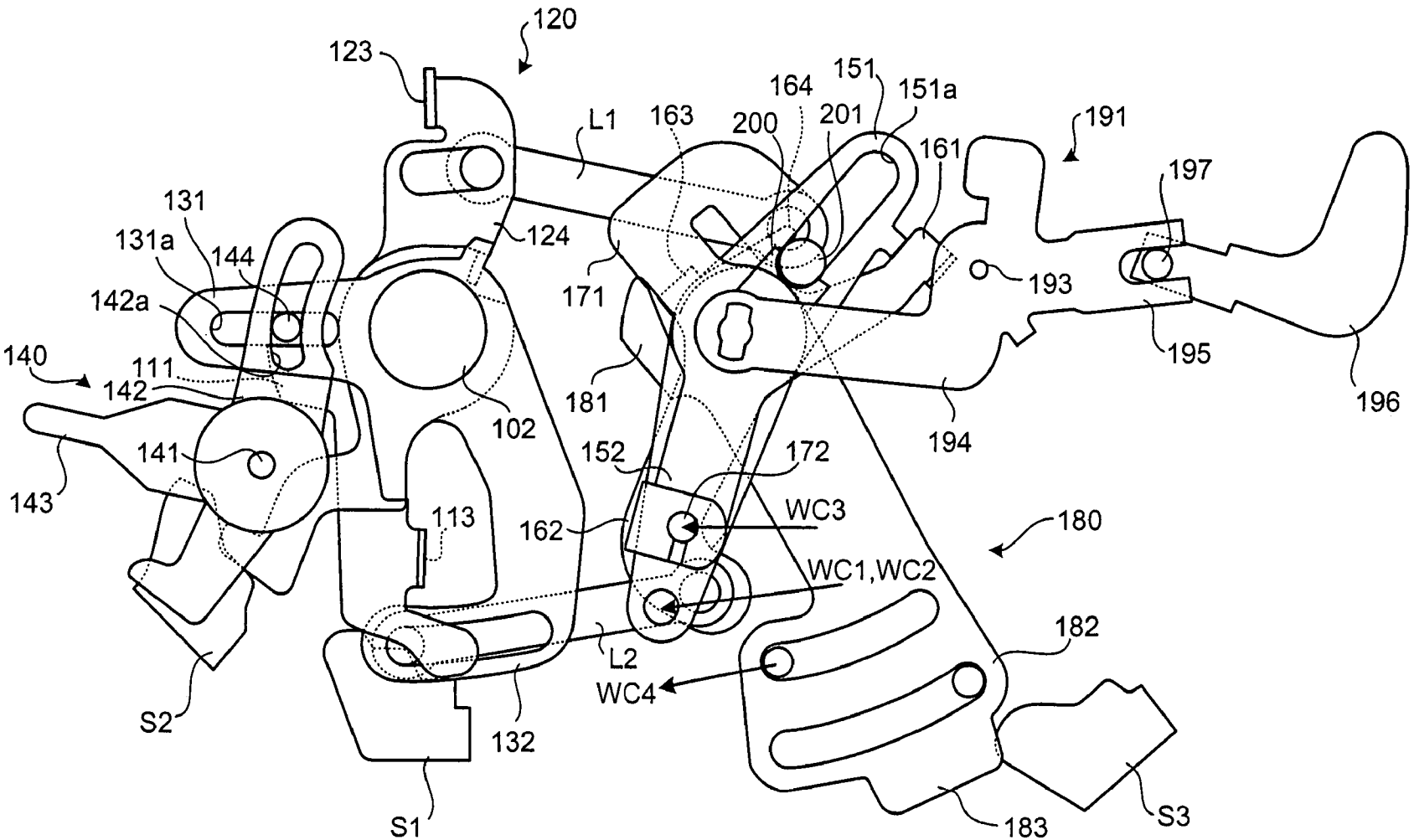
FIG. 12 is a conceptual view of the control unit shown in FIG. 3 when an outside knob is operated.

If the outside knob OK is operated from this initial state, the open handle lever 180 rotates clockwise through the fourth wire cable WC4 as shown in FIG. 12. The rotation of the open handle lever 180 is transmitted to the open sub-lever 160 and the lower open lever 170 through the double lever engagement unit 181, whereby making the open sub-lever 160 and the lower open lever 170 rotate clockwise.

When the open sub-lever 160 rotates clockwise, the rotation of the open sub-lever 160 is transmitted to the open lever 150 through the lock pin engagement unit 164 and the lock pin 201, whereby making the open lever 150 rotates clockwise. By the rotation of the open lever 150, the first wire cable WC1 and the second wire cable WC2 are pulled. Therefore, for example, even if the slide door D is fully closed, the slide door D can be opened and moved by operating the outside knob OK. In addition, for example, even while the closer device CL is in operation, the operation to turn the half latched state to the fully latched state can be discontinued by operating the outside knob OK. Because one end of the second connection link L2 appropriately moves within the elongate hole in the link lever 130 at this time, the clockwise rotation of the open sub-lever 160 does not make the link lever operate.

On the other hand, when the lower open lever 170 rotates clockwise, the third wire cable WC3 is pulled and the fully opening latch unit OR is released. Therefore, for example, even if the slide door D is fully opened, the slide door D can be closed and moved by operating the outside knob OK.

When the open handle lever 180 rotates clockwise, the third door operation detection unit 183 turns on the third door operation detection sensor S3. Therefore, it is possible to detect that the outside knob OK is operated based on a detection result of the third door operation detection sensor S3.

Figure 13:
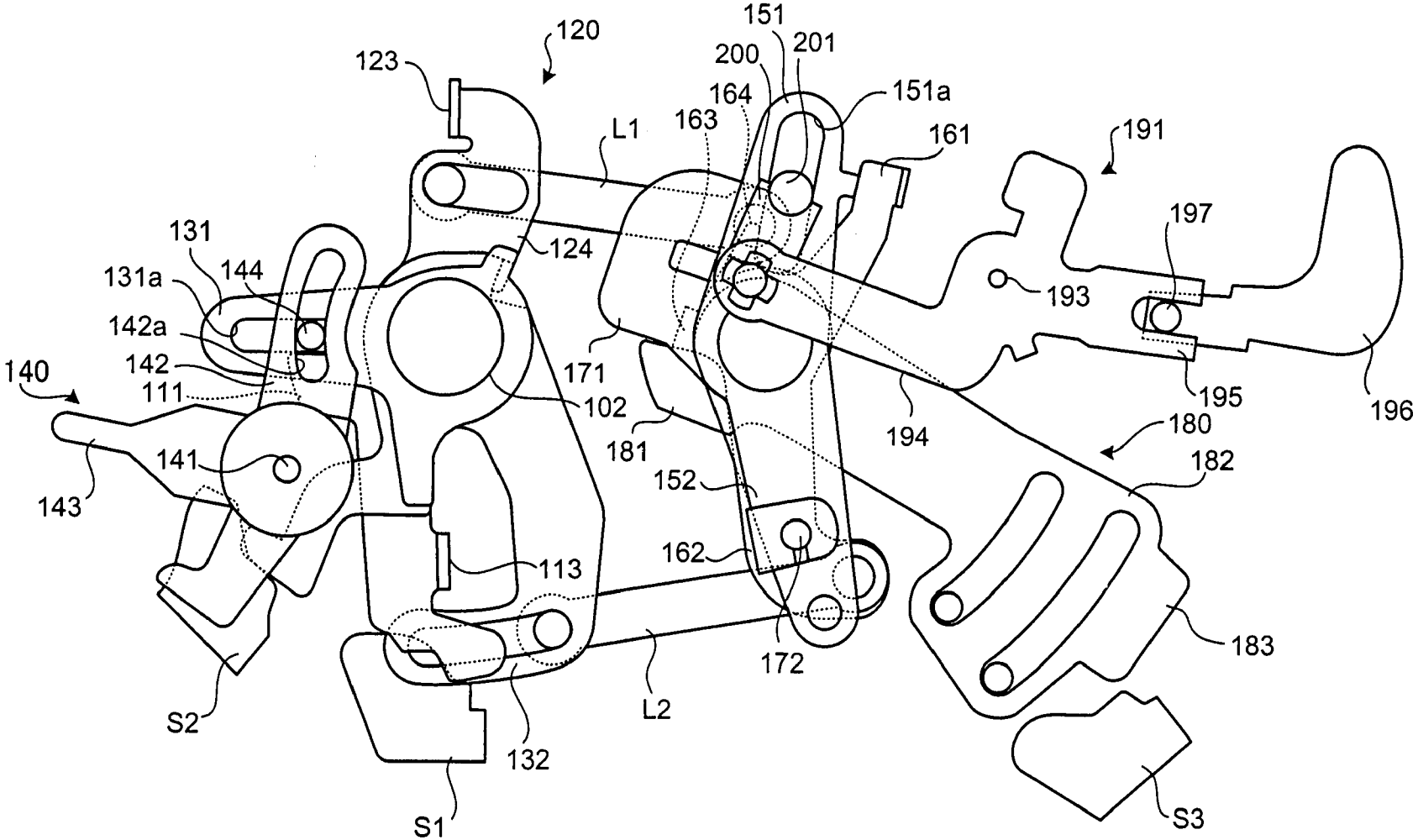
FIG. 13 is a conceptual view of the control unit shown in FIG. 3 in a locked state.
Figure 14:
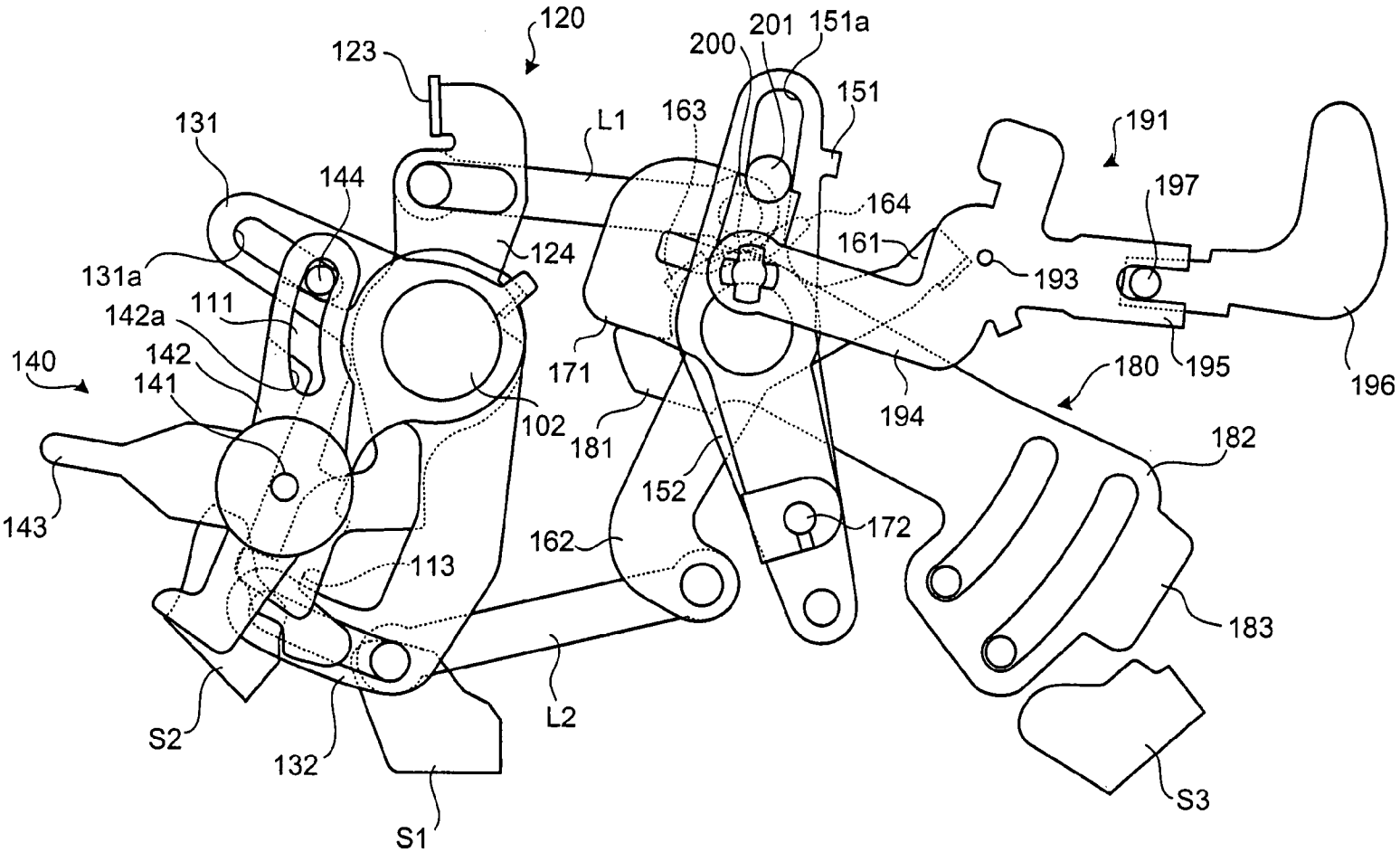
FIG. 14 is a conceptual view of the control unit shown in FIG. 3 when the inside knob is operated to open the door in the locked state.

When the lock unit 190 is switched to the locked state from the initial state, the lock pin 201 is located outside of the area in which the lock engagement unit 164 makes rotational movement as shown in FIG. 13. Accordingly, even if the inside knob IK is tilted toward the vehicle rear side from the locked state, the rotation transmitted to the open sub-lever 160 through the door opening lever 110 and the second connection link L2 is not transmitted to the open lever 150. Therefore, the front fully closing latch unit CR is not to be released. However, even if the lock unit 190 is in the locked state, the rotation of the opening lever 110 enables the first door operation detection unit 114 to turn on the first door operation detection sensor S1. Therefore, it is possible to detect that the inside knob IK is tilted toward the vehicle rear side based on the detection result of the first door operation detection sensor S1.

Figure 15:
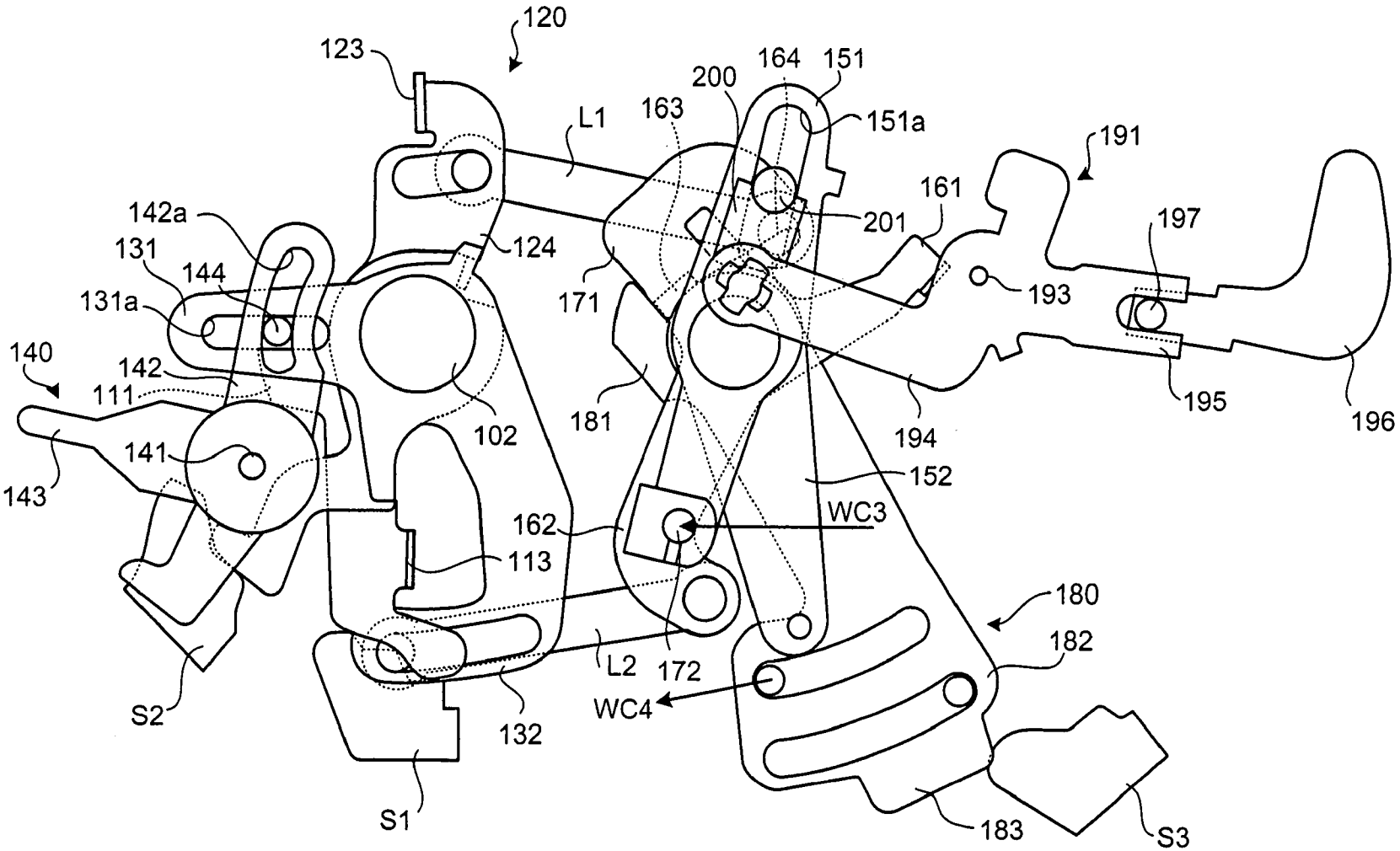
FIG. 15 is a conceptual view of the control unit shown in FIG. 3 when the outside knob is operated is in the locked state.

Furthermore, even if the outside knob OK is operated from the locked state shown in FIG. 13, the rotation of the open sub-lever 160 following the rotation of the open handle lever 180 is not transmitted to the open lever 150 as shown in FIG. 15. Therefore, the fully closing latch unit CR is not to be released. However, even in the locked state, the rotation of the open handle lever 180 is transmitted to the lower open lever 170 through the double lever engagement unit 181, and the third wire cable WC3 is pulled. As a result, for example, even if the slide door D is fully opened, the slide door D can be closed and moved by operating the outside knob.

Figure 16:
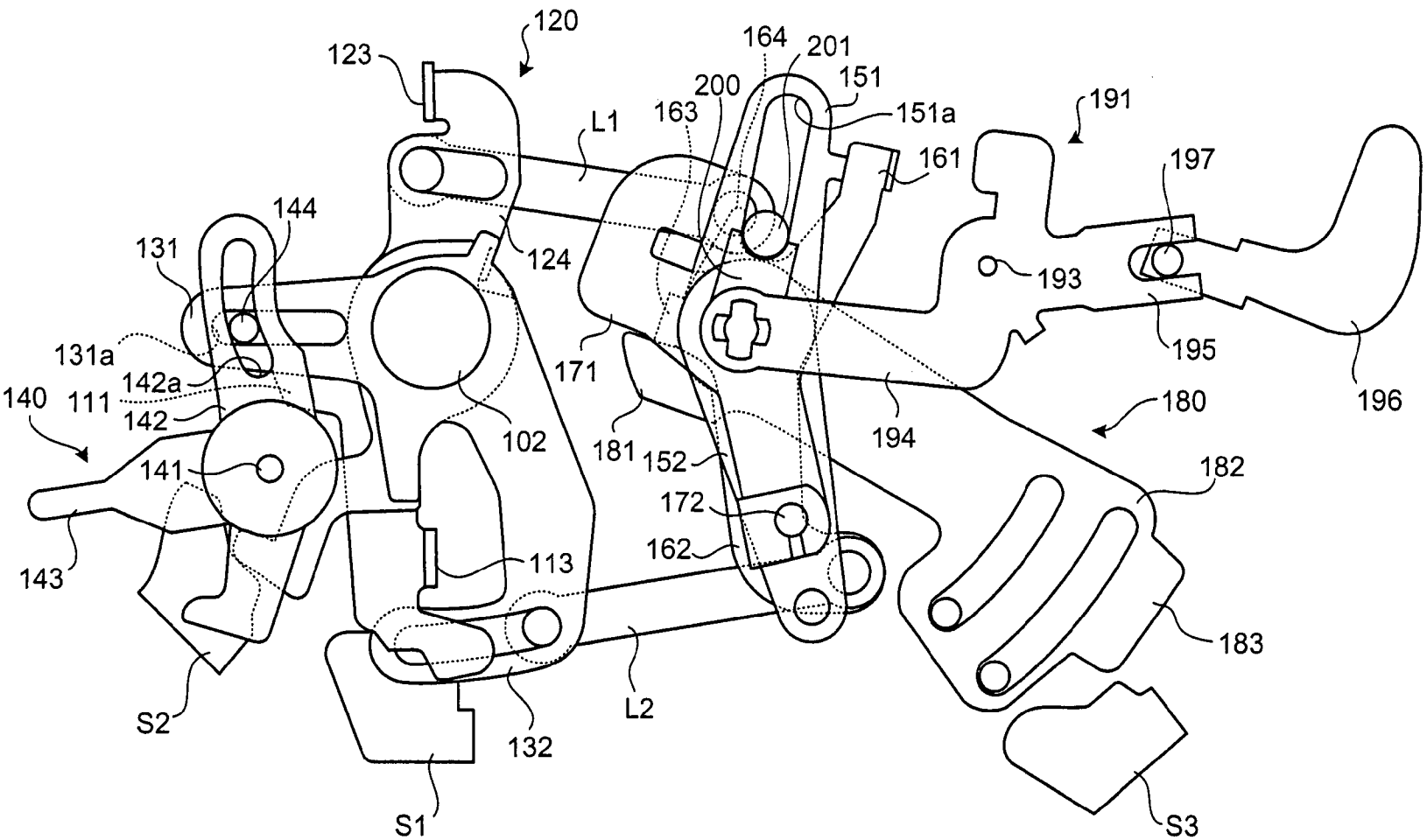
FIG. 16 is a conceptual view of the control unit shown in FIG. 3 in a child lock state.
Figure 17:
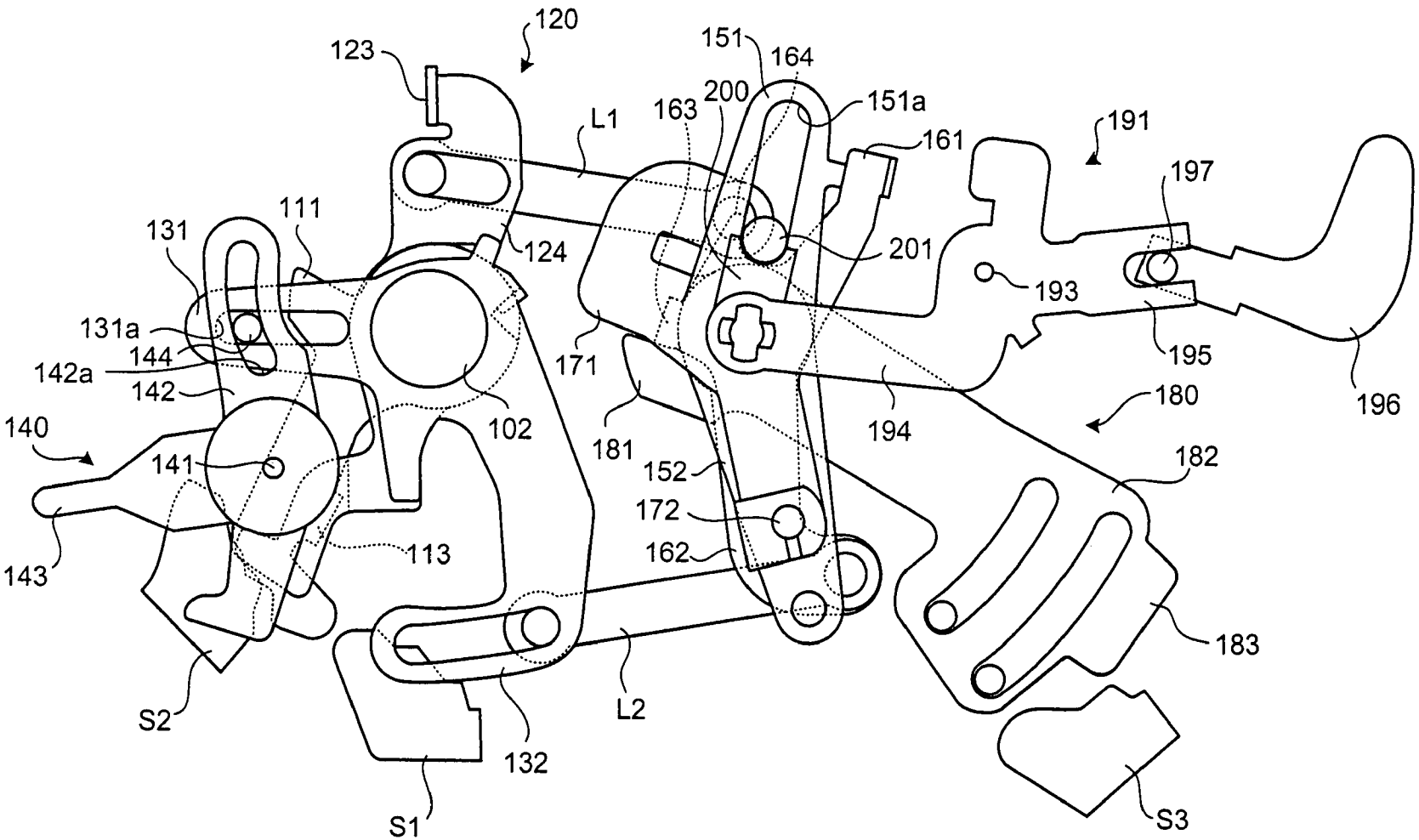
FIG. 17 is a conceptual view the control unit shown in FIG. 3 when the inside knob is operated to open the door in the child lock state.

When the child lock lever 140 is switched to the lock position from the initial state, the engagement pin 144 on the pin slide unit 131 of the link lever 130 is located outside of the area in which the link engagement unit 111 makes the rotational movement as shown in FIG. 16. Therefore, even if the inside knob IK is tilted toward the vehicle rear side from this state, the rotation of the door opening lever 110 is not transmitted to the link lever 130 as shown in FIG. 18. Therefore, the front fully closing clutch unit CR is not to be released. However, even in this state, the rotation of the door opening lever 110 enables the first door operation detection unit 114 to turn on the first door operation detection sensor S1. Therefore, it is possible to detect that the inside knob IK is tilted toward the vehicle rear side based on the detection result of the first door operation detection sensor S1.

According to the present invention, the inside knob and the door operation lever can be mounted to the door as an integral member. In addition, an assembly of the apparatus can be facilitated.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An apparatus for opening and closing a sliding door of a vehicle, which allows a sliding door of a vehicle to be slidably moved between an open and closed position, comprising:

an inside knob unit;

a door operation lever unit that is rotated when an the inside knob unit is operated;

a door holding unit that is released by rotation of the door operation lever unit, wherein the door holding unit includes a fully closing holding unit that holds the door to be fully closed, and a fully opening holding unit that holds the door to be fully opened;

an operation output unit that is included in the inside knob unit; and a base plate on which the inside knob unit is arranged in such a manner that the inside knob unit is moved to be operated, and on which the door operation lever unit is arranged in such a manner that the door operation lever unit partially faces an area in which the operation output unit is moved in response to an operation of the inside knob unit, wherein the door operation lever unit is rotated by making the operation output unit abut on the door operation lever unit when the inside knob unit is operated, wherein the door operation lever unit includes a door opening lever that releases the fully closing holding unit when the door operation lever is rotated in response to the operation of the inside knob unit to open the door, and a door closing lever that releases the fully opening holding unit when the door operation lever is rotated in response to the operation of the inside knob unit to close the door, and the inside knob unit includes a first operation output unit and a second operation output unit each being operative to rotate one of the door opening lever and the door closing lever, respectively, wherein the inside knob unit is arranged on the base plate in such a manner that the inside knob unit can be knocked around an operation shaft as an axis, the operation shaft being arranged substantially orthogonal to the axis of the rotation of the door opening lever and the door closing lever, and the operation output unit is arranged on both sides of the operation shaft across the axis of rotation, and when the inside knob unit is rocked in a first direction, the door opening lever is rotated through one of the operation output units, and when the inside knob unit is rocked in a second direction, the door closing lever is rotated through the other operation unit, wherein the inside knob unit is operated in the first direction to relay the fully closing holding unit, and the inside knob unit is operated in the second direction to release the fully opening holding unit.

2. The apparatus according to claim 1, wherein the door opening lever and the door closing lever are arranged on the base plate in such a manner that an axis of rotation of the door opening lever and an axis of rotation of the door closing lever are substantially concentric with each other, and that each of the door opening lever and the door closing lever extends in a direction away from each other.

* * * * *